US007985056B2

(12) United States Patent
Chou et al.

(10) Patent No.: US 7,985,056 B2
(45) Date of Patent: Jul. 26, 2011

(54) FAN AND FAN ASSEMBLY

(75) Inventors: Yi-Fang Chou, Taoyuan Hsien (TW); Hui-Chun Chang, Taoyuan Hsien (TW); Chang-Yi Lu, Taoyuan Hsien (TW); Li-Chen Lin, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 653 days.

(21) Appl. No.: 12/027,910

(22) Filed: Feb. 7, 2008

(65) Prior Publication Data

US 2008/0279694 A1 Nov. 13, 2008

(30) Foreign Application Priority Data

May 11, 2007 (TW) ..... 96116767 A

(51) Int. Cl.
*F04B 35/04* (2006.01)

(52) U.S. Cl. ..... 417/423.14; 417/247; 415/213.1; 361/695

(58) Field of Classification Search ..... 417/423.7, 417/423.14, 244, 247; 361/695, 696, 697; 165/244; 415/213.1
See application file for complete search history.

(56) References Cited

U.S. PATENT DOCUMENTS

| | | | | |
|---|---|---|---|---|
| 5,788,467 | A * | 8/1998 | Zenitani et al. | 417/360 |
| 6,817,889 | B2 * | 11/2004 | Chang et al. | 439/485 |
| 6,827,549 | B1 * | 12/2004 | Horng et al. | 415/68 |
| 7,033,206 | B2 * | 4/2006 | Chang et al. | 439/485 |
| 7,168,912 | B2 * | 1/2007 | Sun | 415/66 |
| 7,177,149 | B2 * | 2/2007 | Lin | 361/695 |
| 7,273,400 | B2 * | 9/2007 | Horng et al. | 439/660 |
| 2002/0094283 | A1 * | 7/2002 | Salmen et al. | 417/360 |
| 2003/0019646 | A1 * | 1/2003 | Clements et al. | 174/50 |
| 2003/0161103 | A1 * | 8/2003 | Wrycraft et al. | 361/695 |
| 2005/0105271 | A1 * | 5/2005 | Lu et al. | 361/695 |
| 2006/0262499 | A1 | 11/2006 | Vinson et al. | |
| 2007/0003413 | A1 * | 1/2007 | Hsu et al. | 415/199.5 |
| 2008/0124234 | A1 * | 5/2008 | Echazarreta | 417/423.14 |

FOREIGN PATENT DOCUMENTS

| | | |
|---|---|---|
| CN | 1422052 A | 6/2003 |
| CN | 1641476 A | 7/2005 |
| TW | 200708240 | 4/1995 |
| TW | M302250 | 6/1995 |

* cited by examiner

*Primary Examiner* — Devon C Kramer
*Assistant Examiner* — Peter J Bertheaud
(74) *Attorney, Agent, or Firm* — Birch, Stewart, Kolasch & Birch, LLP

(57) ABSTRACT

A fan includes an impeller, a motor, a circuit board, a fan frame and a connecting member. The motor is used to drive the impeller to rotate. The circuit board is electrically connected to the motor. The impeller and the motor are accommodated in the fan frame. The connecting member is disposed at one side of the fan frame. The circuit board is disposed between the connecting member and the fan frame. Also, a fan assembly including such two fans is also disclosed.

13 Claims, 5 Drawing Sheets

FAN AND FAN ASSEMBLY

CROSS REFERENCE TO RELATED APPLICATIONS

This Non-provisional application claims priority under 35 U.S.C. §119(a) on Patent Application No(s). 096116767, filed in Taiwan, Republic of China on May 11, 2007, the entire contents of which are hereby incorporated by reference.

BACKGROUND OF THE INVENTION

1. Field of Invention

The present invention relates to a fan and a fan assembly, and in particular to a fan having the improved arrangement of a circuit board, and a fan assembly.

2. Related Art

With the enhancements of functions and operating speeds of electronic products, heat generated is correspondingly increased during the operation of the electronic products. In order to keep the normal operation of the electronic products, a fan is provided to dissipate heat in the prior art.

Because the efficiency and the miniaturized requirement of the modern electronic product are increased, the heat dissipating requirement is correspondingly increased. In view of this, it is an important subject to increase the efficiency of the fan in this industry. In the prior art, the efficiency of the fan is increased by reducing the size of the impeller or increasing the rotating speed of the fan. However, such a design accompanies the larger current for driving the motor to rotate. In other words, more electronic components or a larger electronic component is needed to drive the motor to rotate. As the results, the space for the circuit board 123 becomes insufficient. Referring to FIG. 1, which is a schematic illustration showing a structure of a conventional fan 1. In FIG. 1, the impeller 11, the motor 12, and the circuit board 123 are accommodated in the fan frame 13. In order to enlarge the space for containing more electronic components on the circuit board, a projecting lug 123*a* is designed at the outer periphery of the circuit board 123. However, because the lug 123*a* is non-symmetrically disposed on the circuit board 123 and extends outwardly from the periphery to the circuit board 123, the flowing directions and the flows of the air streams are influenced by the lug 123*a* and thus the turbulence or vortex phenomenon are generated. As the results, the efficiency of the fan 1 is decreased and noises are generated. Such results become more apparent in the small-sized fan.

SUMMARY OF THE INVENTION

In view of the foregoing, the present invention is to provide a fan and a fan assembly having the improved arrangement of a circuit board without influencing the stability of air streams and having the enlarged air rail to enhance the efficiency of the fan.

To achieve the above, the present invention discloses a fan including an impeller, a motor, a circuit board, a fan frame and a connecting member. The motor drives the impeller to rotate. The circuit board is electrically connected to the motor. The fan frame accommodates the impeller and the motor. The connecting member is disposed at one side of the fan frame, and the circuit board is disposed in the connecting member.

To achieve the above, the present invention also discloses a fan assembly including at least two fans, at least one circuit board and at least one connecting member. The fans are connected together in series. Each fan has a fan frame, and the circuit board is electrically connected to the motor of the fans. The connecting member is disposed at one side of the fan frame, and the circuit board is disposed between the connecting member and the fan frames.

As mentioned above, because the fan and the fan assembly of the present invention have a design that the circuit board is disposed on the external surface of the fan frame, i.e. the circuit board is not accommodated in the fan frame, the circuit board cannot influence the flowing direction of the air streams. Compared with the prior art, generation of the turbulence and the vortex can be avoided, and the efficiency of the fan can be enhanced. In addition, the circuit board is disposed outside the fan frame, and the utility area of the circuit board can be enlarged. Moreover, the number of the electronic components or the sizes of the electronic components disposed on the circuit board are not particularly restricted so that the structure design can become more flexible.

BRIEF DESCRIPTION OF THE DRAWINGS

The present invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
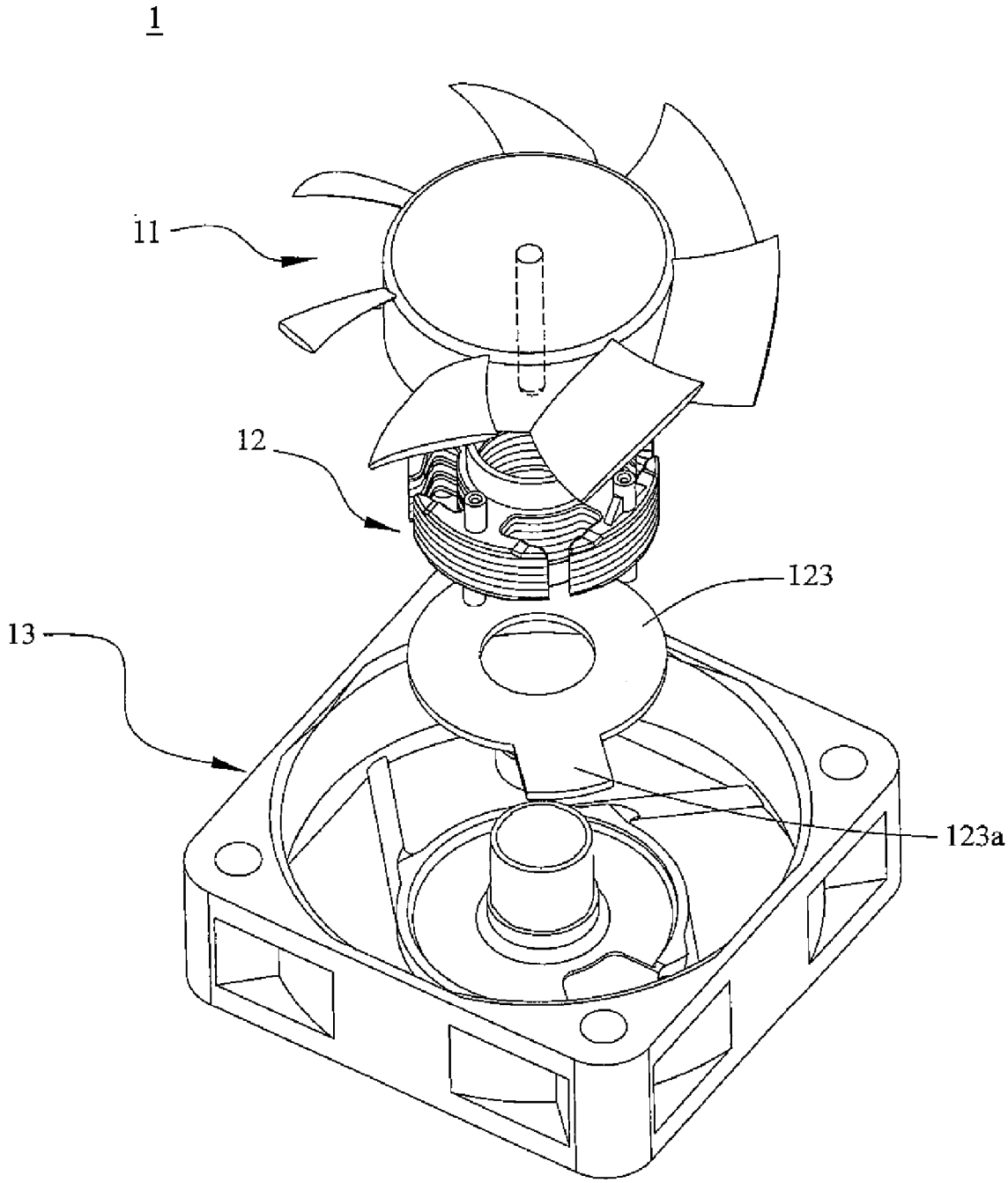
FIG.1(PRIOR ART)
FIG. 1 is a schematic illustration showing a conventional fan.
Figure 2:
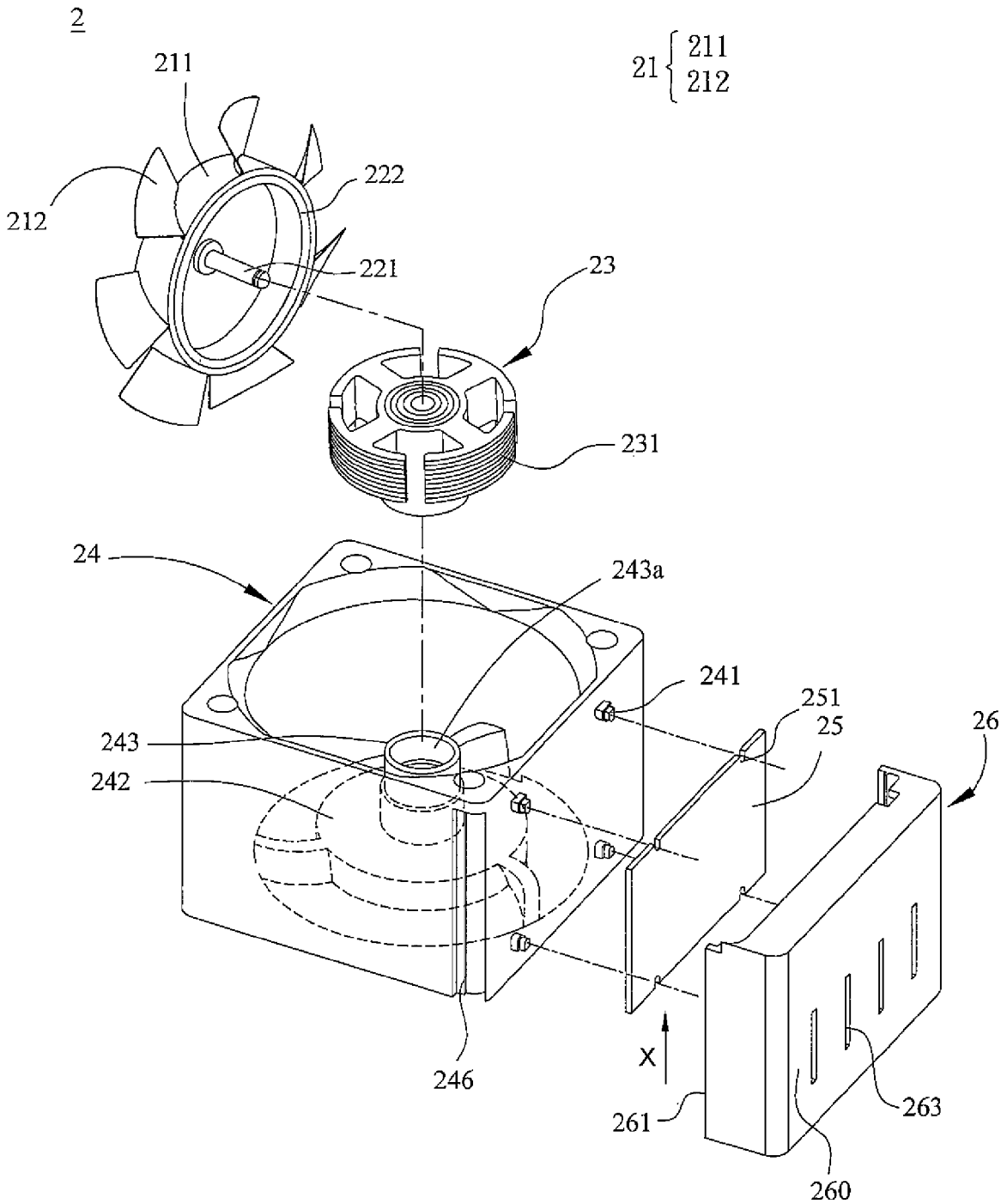
FIG. 2 is a schematic illustration showing a fan according to a first embodiment of the present invention.

FIG. 2 is a schematic illustration showing a structure of a fan 2 according to a first embodiment of the present invention. Referring to FIG. 2, the fan 2 includes an impeller 21, a motor 23 and a fan frame 24. The impeller 21 includes a hub 211 and a plurality of blades 212 disposed around the hub 211, and there is a rotating shaft 221 connected to the hub 211. The magnetic element 222 is disposed and attached on an inner surface of the hub 211. The magnetic element 222 can be, for example, a permanent magnet, or an electronic magnet. The motor 23 is for driving the impeller 21 to rotate, and the motor 23 includes several silicon steel sheets stacked together and then a coil is wound around these silicon steel sheets. Also, the silicon steel sheets are disposed with respect to the magnetic element 222.

As mentioned hereinabove, the base 242 has a bearing tube 243 and the base 242 is for supporting the motor 23. When the motor 23 and the impeller 21 are assembled, the rotating shaft 221 is disposed within the shaft hole 243*a* of the bearing tube 243, and the motor 23 covers the bearing tube 243, and thus the impeller 21 rotates with respect to and driven by the motor 23.

Referring to FIG. 2 again, the fan 2 of this embodiment further includes a circuit board 25 disposed at outside of the fan frame 24. In this embodiment, the fan frame 24 has at least one fastener 241, such as four fasteners, disposed at outside of the fan frame 24. The fastener 241 is, for example, a protrusion. The circuit board 25 has a plurality of notches 251 at the periphery of the circuit board 25, and the fastener 241 is correspondingly disposed on the notch 251 so that the circuit board 25 can be disposed at outside of the fan frame 24 and connected to the fan frame 24 via the fastener 241 engaging with the notch 251. The shape of the notch 251 corresponds to the shape of the fastener 241. More specifically, the shape of the notch 251 is designed according to the shape of the fastener. In addition, the circuit board 25 is electrically connected to the motor 23 through, for example, a wire or a cable (not shown).

Because the circuit board 25 of this embodiment is disposed at one side of the fan frame 24, a smaller circuit board is needed to be disposed in the hub 211 for disposing particular components, such as a Hall sensor, so that the circuit board 25 can have sufficient space for accommodating other electronic components, and the problems of the stability and the balance of the air streams in the prior art can be improved.

In addition, the fan 2 of the present invention further includes a connecting member 26, which is disposed at one side of the fan frame 24 and covers the circuit board 25. In this embodiment, the connecting member 26 is a cover having a rectangular shape or other shapes. The connecting member 26 has a bottom 260 and two sidewalls 261 connected to the bottom. The connecting member 26 is connected to the fan frame 24 by way of sliding, engaging or hooking. In other words, the connecting member 26 is detachably disposed on the fan frame 24. In addition, the fan frame has at least two sliding rails 246 disposed at a peripheral corner of the fan frame 24. The sidewall 261 of the connecting member is correspondingly disposed on the sliding rail 246. When the connecting member 26 of this embodiment slides into the sliding rail 246 along a predetermined direction X, the connecting member 26 is connected to and combined with the fan frame 24. When one of the electronic components on the circuit board 25 needs to be repaired or the circuit board 25 has to be replaced, reworking is needed to be performed. As the time, it is only necessary to slide the connecting member 26 along a direction, which is reverse to the predetermined direction X, and the connecting member 26 is easily disconnected and separated from the fan frame 24 so that the circuit board 25 can be easily took out.

In order to effectively dissipate heat generated by the fan 2 during its operation, at least one heat dissipating hole 263 is disposed on the bottom of the connecting member 26 for dissipating heat to outside of the fan and thus prevent the beat from being accumulated to influence the efficiency of the fan 2. It is to be noted that the fastener 241 of this embodiment is not restricted to that disposed at one side of the fan frame 24. Instead, the fastener 241 can be disposed on the connecting member 26 (not shown), then the circuit board 25 is firstly engaged with and supported by the connecting member 26, and then connected to the fan frame 24 through the connecting member 26 so that the circuit board 25 is disposed at one side of the fan frame 24.

Figure 3:
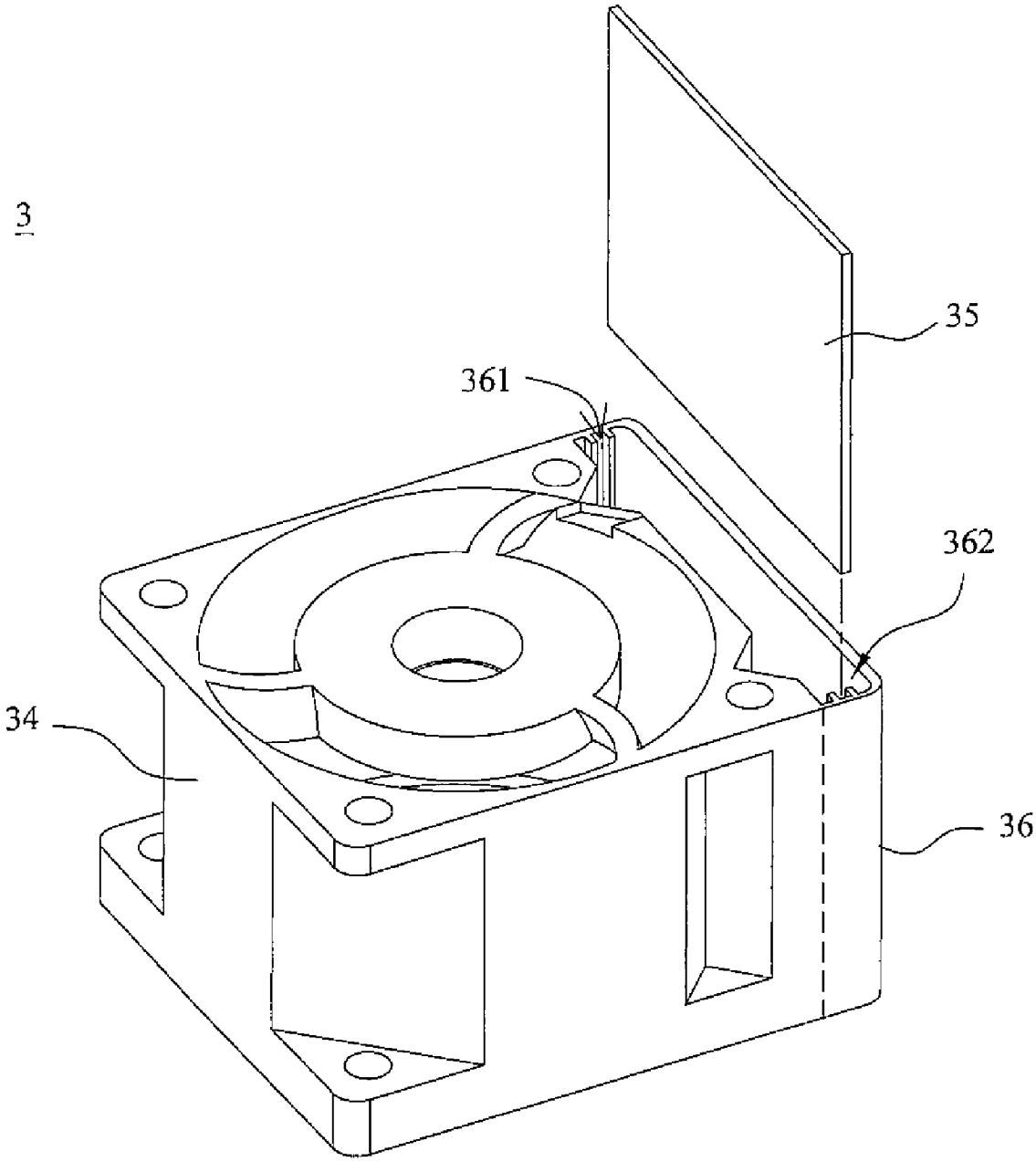
FIG. 3 is a schematic illustration showing a fan according to a second embodiment of the present invention.

FIG. 3 is a schematic illustration showing a structure of a fan 3 according to a second embodiment of the present invention. As shown in FIG. 3, the difference between the fan 3 of this embodiment and the fan of the first embodiment is that the fan 3 of this embodiment has a connecting member 36 disposed at one side of a fan frame 34, and the connecting member 36 and the fan frame 34 are integrally formed as a single unit. In other words, the connecting member 36 becomes one part of the fan frame 34. In this embodiment, the connecting member 36 has at least one opening 362 and a slot 361. A circuit board 35 is disposed in the connecting member 36 and is connected with the slot 361 362 after sliding through the opening. Thus, the circuit board 35 of this embodiment slides into and is accommodating in the connecting member 36.

Figure 4:
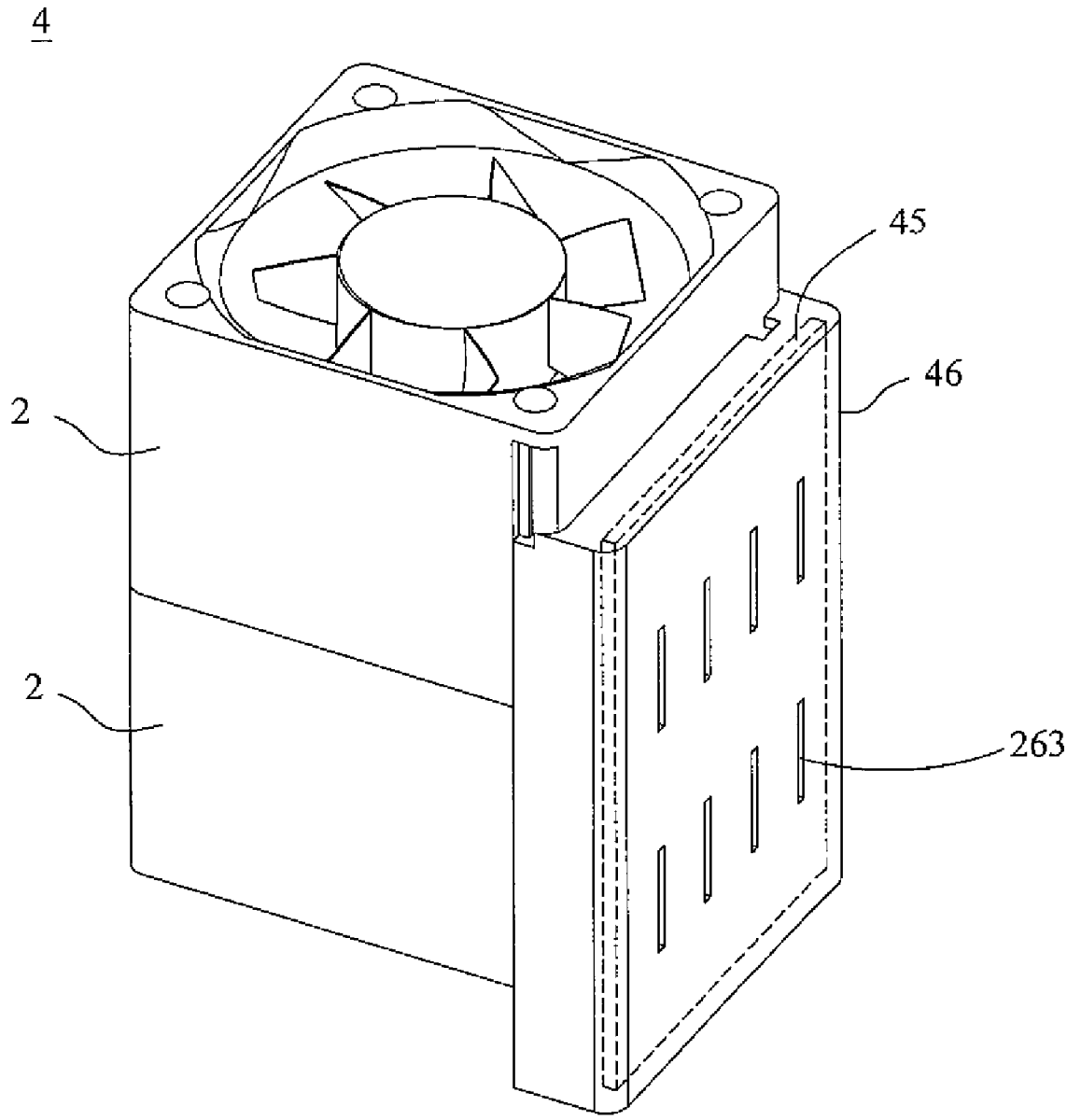
FIG. 4 is a schematic illustration showing a fan assembly according to the preferred embodiment of the present invention.

FIG. 4 is a schematic illustration showing a structure of a fan assembly 4 according to the preferred embodiment of the present invention. As shown in FIG. 4, the fan assembly 4 includes two fans 2 connected in series and connected together. The number of fans constituting the fan assembly is not limited to that shown in FIG. 4, and can be adjusted according to the actual requirements. The structure and the function of each fan 2 are similar to those of the fan of the first embodiment, so detailed descriptions thereof will be omitted.

In this embodiment, the fans 2 may have a single common circuit board 45, or each fan 2 has its individual circuit board 45. In FIG. 4, the fans 2 have a single common circuit board 45 and a common connecting member 46. Of course, each fan 2 may have its individual connecting member 46. Therefore, the connecting members 46 of the fans 2 of this embodiment can respectively support the circuit boards of the fans 2, or the common connecting member 46 of the fan assembly 4 can accommodate the common circuit board 45. In addition, the surface of the connecting member has a plurality of heat dissipating holes 263 for dissipating heat generated by the fans 2 to the outside of the fan assembly 4.

Figure 5:
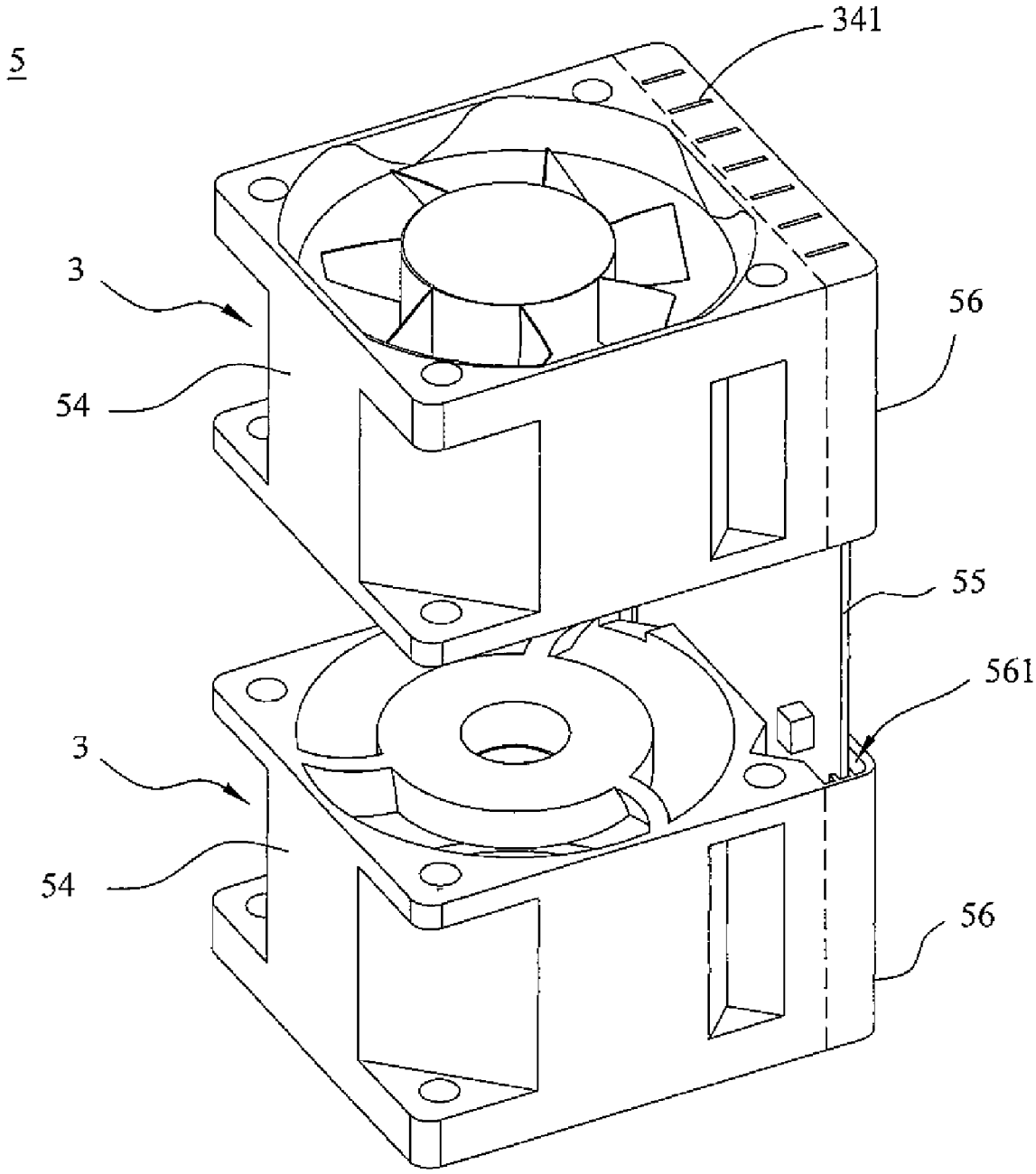
FIG. 5 is a schematic illustration showing another fan assembly according to the preferred embodiment of the present invention.

FIG. 5 is a structure schematic illustration showing another fan assembly 5 according to the preferred embodiment of the present invention. As shown in FIG. 5, the fan assembly 5 includes two fans 3. The number of the fans 3 constituting the fan assembly is not restricted to that shown in FIG. 5, and can be adjusted according to the actual requirements. The structure and the function of each fan 3 are similar to those of the fan of the second embodiment, so detailed descriptions thereof will be omitted. Each fan 3 of the fan assembly 5 has a connecting member 56, which has at least one opening 561. Fan frames 54 of the two fans are connected together so that the common circuit board 55 is disposed in a closed space formed after the two connecting members 56 are combined together to protect the circuit board 55 and the electronic components disposed on the circuit board 55. In addition, the fan assembly 5 of this embodiment has a plurality of heat dissipating holes 341 disposed on the surface of the connecting member 56.

In summary, because the fan and the fan assembly of the present invention have a design that the circuit board is disposed on the external surface of the fan frame, i.e. the circuit board is not accommodated in the fan frame, the circuit board cannot influence the flowing direction of the air streams. Compared with the prior art, generation of the turbulence and the vortex can be avoided, and the efficiency of the fan can be enhanced. In addition, the circuit board is disposed outside the fan frame, and the utility area of the circuit board can be enlarged. Moreover, the number of the electronic components or the sizes of the electronic components disposed on the circuit board are not particularly restricted so that the structure design can become more flexible.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan, comprising:

an impeller and a motor for driving the impeller to rotate;

a circuit board electrically connected to the motor;

a fan frame for accommodating the impeller and the motor; and a connecting member disposed at one side of the fan frame, wherein the circuit board is disposed between the connecting member and the fan frame, wherein the connecting member comprises a bottom and a plurality of sidewalls connected to the bottom, the fan frame comprises at least one sliding rail disposed at a peripheral corner of the fan frame, one of the sidewalls of the connecting member correspondingly disposed on the sliding rail, and wherein the connecting member is connected to and combined with the fan frame while the connecting member slides into the sliding rail.

2. The fan according to claim 1, wherein the connecting member is a cover for accommodating the circuit board.

3. The fan according to claim 1, wherein the the bottom comprises at least one heat dissipating hole for dissipating heat from the fan.

4. The fan according to claim 1, further comprising at least one fastener disposed at the side of the fan frame or on the connecting member, and the fastener comprises a protrusion.

5. The fan according to claim 4, wherein the circuit board has a plurality of notches disposed on a periphery of the circuit board, and the fastener is correspondingly disposed on one of the notches so that the circuit board is disposed at outside of the fan frame and connected to the fan frame via the fastener engaging with a notch.

6. The fan according to claim 1, wherein the circuit board is electrically connected to the motor through a wire or a cable.

7. A fan assembly, comprising:

at least two fans connected together, each of the fans has a fan frame;

at least one circuit board electrically connected to the fans; and at least one connecting member disposed at one side of each fan frame, wherein the circuit board is disposed between the connecting member and the fan frames, wherein the connecting member comprises a bottom and a plurality of sidewalls connected to the bottom, each of the fan frames comprises at least one sliding rail disposed at a peripheral corner of the fan frame, one of the sidewalls of the connecting member correspondingly disposed on the sliding rails, and wherein the connecting member is connected to and combined with the fan frame while the connecting member slides into the sliding rails.

8. The fan assembly according to claim 7, wherein the connecting member is a cover for accommodating the circuit board.

9. The fan assembly according to claim 7, wherein the bottom comprises at least one heat dissipating hole for dissipating heat from the fan.

10. The fan assembly according to claim 7, further comprising at least one fastener disposed at the side of the fan frame or on the connecting member, and the fastener comprises a protrusion.

11. The fan assembly according to claim 10, wherein the circuit board has a plurality of notches disposed on a periphery of the circuit board, and the fastener is correspondingly disposed on one of the notches so that the circuit board is disposed at outside of the fan frame and connected to the fan frame via the fastener engaging with a notch.

12. The fan assembly according to claim 7, wherein the circuit board is electrically connected to a stator of motor through a wire or a cable, and the fans are connected in series.

13. The fan assembly according to claim 7, wherein the circuit board is a common member for the two fans, and the connecting member is another common member for accommodating the circuit board.

* * * * *